United States Patent [19]

Carlson et al.

[11] 3,935,398

[45] Jan. 27, 1976

[54] TRANSDUCER WITH IMPROVED ARMATURE AND YOKE CONSTRUCTION

[75] Inventors: Elmer V. Carlson, Prospect Heights; August F. Mostardo, Jr., Norridge; Alex V. Diblick, Elmhurst, all of Ill.

[73] Assignee: Industrial Research Products, Inc., Elk Grove Village, Ill.

[22] Filed: July 12, 1971

[21] Appl. No.: 161,825

[52] U.S. Cl. ..... 179/114 A; 179/119 A

[51] Int. Cl. ..... H04r 11/00

[58] Field of Search..... 179/114 A, 115 A, 119 A, 179/179 R

[56] References Cited

UNITED STATES PATENTS

| | | | |
|---|---|---|---|
| 3,076,062 | 1/1963 | Fener | 179/119 A |
| 3,249,702 | 5/1966 | Carlson | 179/115 R |
| 3,432,622 | 3/1969 | Sebesta et al. | 179/115 R |
| 3,588,383 | 6/1971 | Carlson et al. | 179/119 A |
| 3,617,653 | 11/1971 | Tibbetts et al. | 179/114 A |
| 3,632,904 | 1/1972 | Mauz | 179/119 R |

FOREIGN PATENTS OR APPLICATIONS

| | | | |
|---|---|---|---|
| 1,146,542 | 4/1963 | Germany | 179/115 A |

*Primary Examiner*—Kathleen H. Claffy
*Assistant Examiner*—George G. Stellar
*Attorney, Agent, or Firm*—Leo J. Aubel; Wilfred S. Stone

[57] ABSTRACT

An electroacoustical transducer of the magnetic armature type having an efficient electromagnetic configuration with the armature being formed integrally with a support yoke. The yoke includes a base from which two arms extend generally parallel to the armature, the two arms engage pole pieces formed of laminations, and the vibrating end of the armature is positioned in the plane of the diaphragm and is connected thereto. The armature may include a boss or gusset adjacent to the contilever end of the armature to stiffen it and thereby raise the resonant frequency of the transducer. A casing is included which is spaced from the yoke and serves as a magnetic shield.

3 Claims, 6 Drawing Figures

TRANSDUCER WITH IMPROVED ARMATURE AND YOKE CONSTRUCTION

This invention relates to electro-acoustic transducers and more particularly to microphones and receivers for use with hearing aids. The motor assembly of the transducer contains a uniquely and integrally constructed armature and yoke assembly, a pole piece stack formed of laminations, and a diaphragm positioned such as to enable the drive end of the armature to be directly connected to the armature. The magnetic configuration of the inventive transducer provides an efficient interaction of the steady state or d.c. flux path and the alternating or a.c. flux path, and, both the d.c. and a.c. flux paths have a relatively low reluctance.

The features and advantages of the invention will be apparent from the following more particular description of a preferred embodiment of the invention as depicted in the accompanying drawings wherein.

Figure 1:
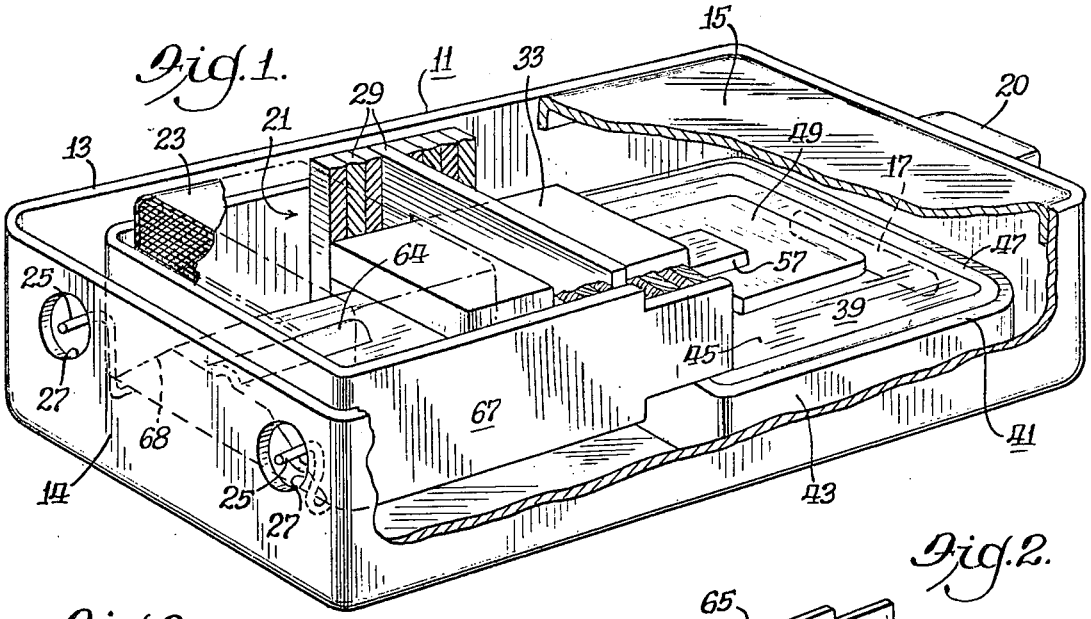
FIG. 1 is a perspective view of the inventive transducer with the cover and part of the casing broken away to show the motor assembly of the transducer.

Referring to the various Figures, the inventive transducer 11 comprises a rectangularly shaped casing 13, having upstanding side walls generally labeled 14 and a cover 15, all of which may be formed of flux conductive material. The cover 15 is secured to the interior surface of walls 14 of the casing 13 and is suitably affixed as by cementing. An aperture 17 which may be formed on an end wall 14, as indicated by dotted lines in FIG. 1, establishes an acoustic coupling to the interior of casing through the coupling member 20, as indicated by the dotted lines 22 in FIG. 5. As is common, an aperture 17 may be formed on a side wall rather than the end wall, and thence coupling member 20 is affixed to wall 14 at that point.

The motor assembly 21 of the transducer 11 includes an electrical coil 23 having leads 25 which pass through apertures 27 in end wall 14 to connect to circuitry externally of casing 13. In assembly, apertures 27 are sealed with suitable cement 28, see FIG. 4 which affix leads 25 in position.

Figure 4:
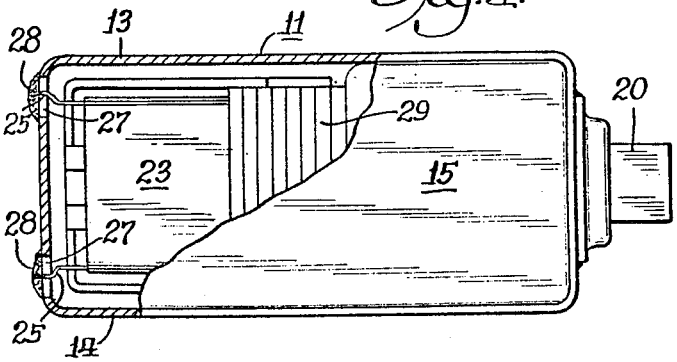
FIG. 4 is a top view of the transducer showing the positioning of the motor assembly within the case.
Figure 5:
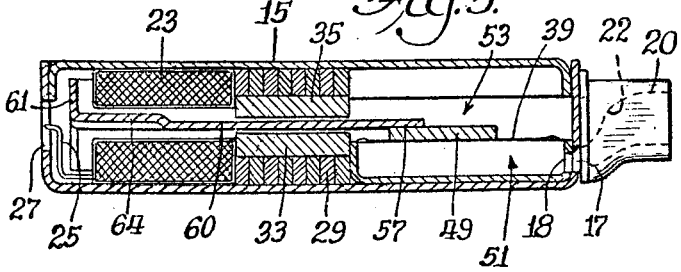
FIG. 5 is a side view of the motor assembly to show the relative longitudinal positioning of the coil assembly, the pole pieces and the diaphragm; and, FIG. 6 is an end view showing the magnets mounted in the enclosed section of the pole piece and the armature in its balanced or neutral position in the air gap formed between the magnets.

The coil 23 is mounted adjacent to a pole piece stack 29, see also FIG. 5. Pole piece stack 29 is comprised of a series of thin laminations, (shown in exaggerated thickness in FIGS. 1, 4 and 5). The use of laminations for the pole piece stack 29 provides the feature of decreasing eddy current losses. As shown in the end view of FIG. 6, pole piece stack 29 is in the form of a rectangular frame having a relatively large central opening or channel forming an enclosure 31 in which a pair of permanent magnets 33 and 35 are mounted in spaced relation to form an air gap 37 therebetween.

A diaphragm assembly 39 is positioned adjacent pole piece 29. Note, that the coil 23, pole piece 29 and diaphragm 39 are positioned adjacent or contiguous to one another in a series or in-line relation. Diaphragm assembly 39 comprises a cup shaped member 41 generally rectangular in shape, with upstanding flanges 43, see FIG. 1. The open side of the cup is closed by a vibratable diaphragm 45. A surround 47 formed along the edge of diaphragm 45 is affixed to the open top of the cup 41 and a substantially rigid plate 49 is affixed to the center of the surface of diaphragm 45.

An aperture 18 on a flange 43 of cup shaped member 41 is positioned in line with aperture 17 on casing wall 14 and couples to the interior of cup member 41 which forms one sound cavity 51 for the transducer 11, see FIG. 5. The other sound cavity 53 is provided between the diaphragm 45 and the cover 15 and is essentially bounded by the casing wall 14.

The vibratable end 57 of a cantilevered reed armature 60 is affixed as by cementing to plate 49. The end 57 is reduced in width to reduce the mass at that end of the armature. As will be explained, the magnetic flow paths do not extend through the end 57 which extends forward of magnets 33 and 35, see FIG. 5, so such reduction in armature width at end 57 has little effect in its magnetic characteristics. The armature 60 extends through the air gap 37 formed between magnets 33 and 35 and through the center of coil 23 and the cantilever end of the armature is formed integrally with a yoke 61.

Figure 2:
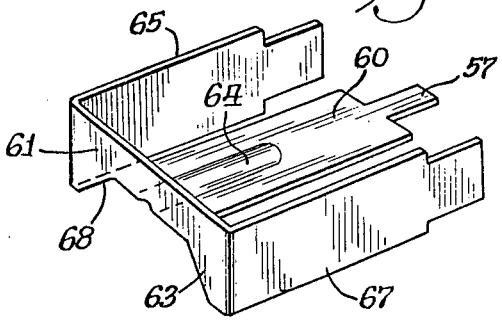
FIG. 2 is a perspective view of the armature of the invention.
Figure 3:
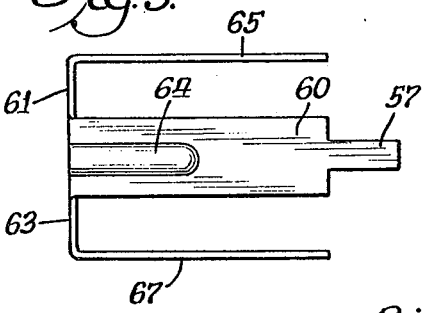
FIG. 3 is a top view of the armature.

Referring now particularly to FIGS. 2 and 3, the yoke 61 comprises a U-shaped band member of a suitable magnetically conductive material having a relatively broad surface and being relatively thin in cross section. Yoke 61 includes a base 63 and a pair of arms 65 and 67. The armature 60 is formed integrally with the base 63 to extend substantially parallel to arms 65 and 67, and with the broad surface of the armature 60 being normal to the broad surface of arms 65 and 67. Armature 60 also includes a boss or gusset 64 adjacent to the cantilever end of armature 60 which stiffens the armature and raise the resonant frequency of transducer 11. The size of the boss or gusset 64 may be adjusted to control the resonant frequency.

Armature 60 extends from approximately the center or midposition of base 63 for convenience in centering the armature in coil 23 and in pole piece stack 29. Base 63 is also notched as at 68 to provide a convenient passageway for the coil leads 25.

Referring also now to FIGS. 1 and 4, the arms 65 and 67 of yoke 61 are positioned to straddle the motor assembly 21 and the ends of arms 65 and 67 are affixed to the external surface of pole piece stack 29. The yoke 61 and arms 65 and 67 are spaced from the casing walls 14, and the casing 13 is not part of the flux path for the motor assembly; and thus, the magnetic flux paths are within the casing 13.

An advantage of the construction of the inventive transducer is that the unit can be made to have a minimal height (see FIG. 5) since the coil assembly 23, the pole piece stack 29 and the diaphragm assembly 39 are all positioned in essentially the same line, and the vibrating end of armature 60 as affixed directly to flat plate 49 on the surface of diaphragm 45.

Figure 6:
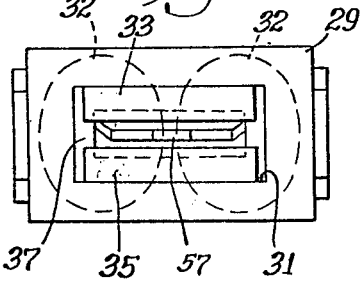

Referring to FIG. 6, the d.c. flux paths indicated by the dotted lines 32 may be traced from permanent magnet 33 to the upper horizontal member of yoke 29 down the vertical members, through the lower horizontal member to magnet 35 and across air gap 37 back to magnet 33. An a.c. flux path may be traced from coil 23 through armature 60, permanent magnet 35, the upper member of yoke 29, the two arms 65 and 67 of yoke 61, and base 63 back to armature 60 and coil 23. Likewise, a second a.c. flux path may be traced from coil 23 through armature 60, permanent magnet 33, the lower member of yoke 29, the two arms 65 and 67 of yoke 61, and base 63 back to armature 60 and coil 23.

Note that the casing 13 is spaced from arms 65 and 67, see FIG. 4, and hence, does not provide a portion of either a.c. or d.c. flux paths, Rather, casing 13 serves as a magnetic shield for the motor assembly 21 as well as a protection against mechanical damage and as an acoustic enclosure.

Another feature of the inventive transducer is that an efficient magnetic configuration is obtained with the magnetic return flow path being provided by the U-shaped yoke 61 which is made of a soft magnetic material with low magnetic reluctance. The armature 60 is formed integrally with the base 63 of yoke 61 and of a strip cut-out or bent approximately 90° out of the plane of the base 63. In such construction the reluctance between the armature and the yoke is also minimal. Accordingly, an efficient transducer having good acoustical response characteristics is obtained.

While the invention has been particularly shown and described with reference to preferred embodiments thereof, it will be understood by those skilled in the art that various changes in form and details may be made therein without departing from the spirit and scope of the invention.

We claim:

1. An electroacoustic transducer of the magnetic armature type comprising a casing having walls, pole piece means forming an enclosed section, magnets positioned in spaced relation to one another within said enclosed section to form an air gap therebetween, a U-shaped band yoke having a base and two similar arms with the free ends of the arms being connected to said enclosed section, a band armature having one end cantilevered from the base of said yoke to minimize reluctance between said armature and said yoke, the broad surfaces of said armature being transverse to the broad surfaces of said base and arms, a coil, portions of said armature positioned in said coil and in said air gap and the a.c. magnetic flux of said transducer extending through said arms to thereby provide an a.c. flux path having minimum reluctance, said arms being positioned in spaced relation to said walls to separate the casing from the magnetic paths of the transducer, the magnetic paths being within the casing whereby the casing functions as a magnetic shield for the transducer, as a protection against mechanical damage and as an acoustic enclosure.

2. An electroacoustic transducer as in claim 1 wherein said pole piece means are formed of laminations.

3. An electroacoustic transducer as in claim 1 wherein said armature includes a boss formed adjacent the cantilever end of said armature to stiffen the armature and raise its resonant frequency.

* * * * *